US006582556B2

(12) United States Patent
Missell et al.

(10) Patent No.: US 6,582,556 B2
(45) Date of Patent: Jun. 24, 2003

(54) SECURITY PAPER AND METHODS FOR PRODUCTION THEREOF

(75) Inventors: Adam Vincent Missell, Appleton, WI (US); Joseph John Tremblay, Claysburg, PA (US); Kathleen Elizabeth Wyles, Hollidaysburg, PA (US)

(73) Assignee: Appleton Papers Inc., Appleton, WI (US)

( * ) Notice: Subject to any disclaimer, the term of this patent is extended or adjusted under 35 U.S.C. 154(b) by 0 days.

(21) Appl. No.: 10/098,088

(22) Filed: Mar. 14, 2002

(65) Prior Publication Data

US 2002/0088580 A1 Jul. 11, 2002

Related U.S. Application Data

(62) Division of application No. 09/870,886, filed on May 31, 2001, now Pat. No. 6,368,455, and a division of application No. 09/224,951, filed on Dec. 31, 1998.

(51) Int. Cl.[7] ..... D21H 19/66; D21H 21/40

(52) U.S. Cl. ..... 162/140; 162/110; 162/135; 162/162; 162/134; 162/184

(58) Field of Search ..... 162/110, 140, 162/162, 134, 135, 184

(56) References Cited

U.S. PATENT DOCUMENTS

| | | | | |
|---|---|---|---|---|
| 28,370 A | | 5/1860 | Howell, Jr. | |
| 30,945 A | | 12/1860 | Karcheski | |
| 77,230 A | | 4/1868 | Woodbury | |
| 672,582 A | | 4/1901 | Affeltranger et al. | |
| 717,799 A | | 1/1903 | Behrend et al. | |
| 987,678 A | | 3/1911 | Howes | |
| 1,281,951 A | | 10/1918 | Harper | |
| 1,687,140 A | | 10/1928 | Pleyer | |
| 1,901,049 A | | 3/1933 | Heinrich | |
| 2,711,120 A | | 6/1955 | MacLaurin | 92/38 |
| 5,766,416 A | | 6/1998 | Hiyoshi et al. | 162/110 |
| 5,871,615 A | | 2/1999 | Harris | 162/140 |
| 5,928,471 A | * | 7/1999 | Howland et al. | 162/140 |
| 6,174,586 B1 | | 1/2001 | Peterson | 428/172 |
| 6,402,888 B1 | * | 6/2002 | Doublet et al. | 162/110 |

FOREIGN PATENT DOCUMENTS

| | | | | |
|---|---|---|---|---|
| JP | 6-272198 | * | 9/1994 | 162/110 |

OTHER PUBLICATIONS

Calkin, Modern Pulp and Paper3rd ed., (1957), Reinhold Publishing, pp. 3312, 313.*

* cited by examiner

*Primary Examiner*—Peter Chin
(74) *Attorney, Agent, or Firm*—Wilhelm Law Service; Thomas D. Wilhelm

(57) ABSTRACT

This invention pertains to security paper and methods of making such security paper. The invention comprises a light-colored base paper having a non-protection area of a first thickness, and a protection area of a second thickness on at least one major surface of the base paper wherein the first thickness is greater than the second thickness. The base paper comprises colorant whereby the protection area exhibits a translucence when viewed using transmitted light, and exhibits the colorant as a darker color indication, relative to the non-protection area, when viewed using reflected light. Transmission of light through a combination of paper fibers and the colorant of the invention, both being disposed at the protection area, is discernibly different from transmission of light through the non-protection areas of the base paper, when viewed with a human eye.

6 Claims, 4 Drawing Sheets

SECURITY PAPER AND METHODS FOR PRODUCTION THEREOF

This application is Divisional of Ser. No. 09/870,886 filed May 31, 2001 U.S. Pat. No. 6,368,455, and a Divisional of Ser. No. 09/224,951—filed Dec. 31, 1998

BACKGROUND

Methods and articles of the invention relate to security paper, i.e. paper which is ideally resistive to counterfeiting or other attempts at fraudulent imitation and which is suitable for use in the production of security documents.

"Security paper" or "security document" generally means any paper or document having a value such as to render it vulnerable to counterfeiting attempts. Typical examples of such papers or documents are papers for use in passports; banknotes; bank checks; traveler's checks; money orders; bankers drafts; bearer bonds; share certificates and other certificates; stamps; postal orders; identity documents; registration documents, driving licences, vehicle road tax licences and other licences or permits; electoral papers; savings or bank account passbooks; lottery tickets; admission tickets; travel tickets; vouchers; coupons; tokens; and shipping and other transport documents; as well as other documents and papers.

Papers for use in labels or distinctive packaging may also be subject to counterfeiting, particularly if they bear a manufacturer's name and/or a brand name. Considerable publicity has been given in recent years to the problems of illegal marketing of cheap copies of branded goods. The copies are liable to be packaged and branded in much the same way as genuine goods from an original or authorised manufacturer. Thus the use of security paper in the labels and/or packaging of the goods provides a means of verifying the authenticity of branded goods. Verifiable label or packaging paper is therefore also within the scope of the term "security paper" as used in this specification.

Further, high security documents, such as passports and banknotes, often carry a palpably-detectable surface profile pattern or design which is imparted to selected areas of the finished paper at the printing stage. The palpable, or tactile, effect can generally be produced by embossing. The palpable pattern enables the document to be partially authenticated by touch, in that a document with no such selective palpable pattern is immediately revealed as counterfeit.

Conventional dry embossed patterns suffer from the drawbacks that they increase production costs at the printing stage, and that they can wear away in use. The intricacy of the pattern applied, and thus the level of security obtainable, is also limited when the pattern is produced by embossing previously formed and dried paper. Additionally, security papers often contain two-sided or backside colorants for bank sorting purposes as well as a line pattern printed on the sheet to deter "cut-and-paste" fraud. Traditionally, these colorant and line pattern features require the paper to be coated and/or printed off line, and thus produce an effect that is easily reproduced by skilled criminals.

It is thus an object of this invention to put some property in the paper which is difficult to copy or otherwise make on small scale, and which will not be reproduced in known copy machines and/or duplicating machines.

It is another object of this invention to teach a security paper wherein transmission of light through one portion of the security paper is discernibly different from transmission of light through another different portion of the security paper, when viewed with a human eye.

It is yet another object of this invention to teach a security paper having substantially the same fiber density throughout the paper.

It is still another object of this invention to teach a security paper which demonstrates reflected light attenuation at at least a first portion of the paper being greater than reflected light attenuation at a second different portion of the paper, so as to appear to leave a darker reflected image at the first portion of the paper than at the second portion.

SUMMARY

In a first family of embodiments, the invention comprehends a security paper comprising a light-colored base paper having a non-protection area of a first thickness, and a protection area of a second thickness on at least one major surface of the base paper wherein the first thickness is greater than the second thickness. The base paper comprises colorant whereby the protection area exhibits a translucence when viewed using transmitted light, and exhibits the colorant as a darker color indication, relative to the non-protection area, when viewed using reflected light.

In preferred embodiments, the thickness of the protection area is preferably sufficiently thin that sufficient transmitted light can pass therethrough to establish color intensity difference between the non-protection area and the protection area.

In preferred embodiments, the thickness of the protection area is sufficiently thin, and fibers of the protection area are sufficiently dispersed, that at least some transmitted light can pass therethrough.

In some embodiments, the colorant is applied to only one major surface of the base paper.

In preferred embodiments, the colorant is disposed on or close to a major surface of the base paper, and selectively congregated in depressions of the protection area, the depressions being defined by the differences in thickness between the non-protection area and the protection area, thus to concentrate the colorant at the protection area.

Transmission of light through a combination of paper fibers and the colorant, both being disposed at the protection area, is discernibly different from transmission of light through the non-protection areas of the base paper, when viewed with a human eye.

Generally, the non-protection area has substantially the same fiber density as the protection area.

In preferred embodiments, quantity and opacity of the colorant at the protection area is sufficiently intense that reflected light attenuation at the protection area is greater than reflected light attenuation at the non-protection area, so as to appear to leave a darker reflected image at the protection area than at the non-protection area.

The second thickness of the protection area is preferably established while solids-content of a precursor web mass of fibers of the base paper is 10% by weight or less, thus enabling lateral movement of fibers and sustaining substantially uniform distribution of fiber density at and adjacent the protection area during establishment of the protection area.

Preferably, the colorant is applied to the base paper when such base paper is substantially dry.

Generally, the colorant comprises at least one of pigments, dyes, and chromogenic materials, such colorants developing color indications under controlled conditions, such as pH, moisture, impact, crushing, and the like.

In some embodiments, the protection area can have the form of at least one of letters, numbers, and symbols.

In some embodiments, the base paper comprises a protection area on both major surfaces thereof.

In a second family of embodiments, the invention comprehends a method of manufacturing security paper. The method includes forming a light-colored base paper having a non-protection area of a first thickness, and a protection area of a second thickness on at least one major surface of the base paper wherein the first thickness is greater than the second thickness. The method also includes treating a major surface of the base paper with a colorant whereby the protection area thus exhibits a translucence when viewed using transmitted light, and exhibits the colorant as a darker color indication, relative to the non-protection area, when viewed using reflected light.

In a third family of embodiments, the invention comprehends a method of manufacturing security paper of varying thickness. The method includes, at a wet end of a papermaking machine, affecting a web mass of base paper fibers, moving in a machine direction, with a patterned roll, while solids-content of the web mass is still 10% by weight or less, thus creating protection areas as depressions in the resultant security paper reflecting the pattern of the roll. The method also includes, after positioning of the paper fibers in the web mass has been substantially established, adding a limited quantity of colorant to at least one side of the base paper such that the colorant congregates selectively in the depressions of the protection areas.

In preferred embodiments, the patterned roll has a rotational velocity different from velocity of the web mass of base paper fibers in the machine direction.

The pattern of the patterned roll preferably comprises an axial peripheral protrusion which is designed and configured to move the paper fibers laterally, thus maintaining the uniform density of such security paper at and adjacent the protection areas.

In some embodiments, the method includes adding the colorant to at least one side of the base paper at a uniform application rate across the protection areas and a non-protection area, wherein the colorant congregates selectively in the depressions of the protection areas due to a pooling effect, thus developing sufficient opacity in the depressions that reflected light attenuation at the protection areas is greater than reflected light attenuation at the non-protection area, so as to exhibit a darker reflected image at the protection areas than at the non-protection area.

In other embodiments, the method includes applying the colorant to at least one side of the base paper, wherein the protection areas exhibit a translucence when viewed using transmitted light, and exhibit the colorant as a darker color indication, relative to non-protection areas, when viewed using reflected light.

Figure 1:
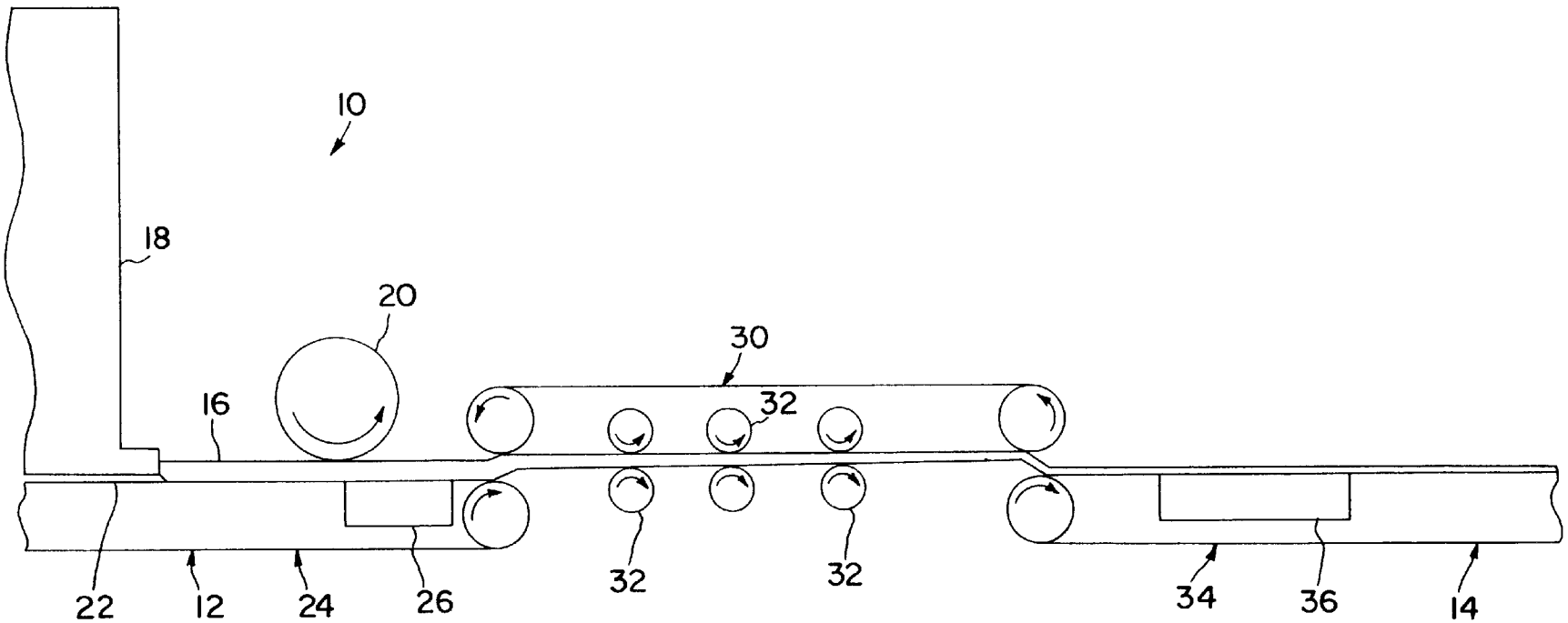
FIG. 1 illustrates a diagrammatic side view of a papermaking machine of the invention.

The invention is not limited in its application to the details of construction or the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring to FIG. 1, this invention is technically related to making security paper on a papermaking machine 10. A first segment of methods of the invention is carried out at wet end 12 of paper machine 10, while solids content of web mass of fibers comprising furnish 16 is about 10% by weight or less, preferably about 7–8% by weight or less, more preferably about 2% by weight or less, considering that furnish 16 generally exits headbox 18 at about 0.5% solids content. Herein, the term "furnish" applies to the mixture of water, wood fibers, and chemicals which is collected in head box 18, and which serves as the precursor for the base paper of security paper of the invention. Furnish 16 is transferred from headbox 18 to forming area 24 which includes forming wire 22 wherein moisture is removed from the furnish simply due to gravitational force. As furnish 16 proceeds in the machine direction, the furnish goes over suction/vacuum device 26 which further removes moisture from the furnish. The paper precursor/furnish is conveyed to press area 30 wherein the paper precursor is run through a series nips formed by press rolls 32, squeezing more moisture from the paper precursor. The paper precursor then transfers to dryer area 34 which includes at least one drying apparatus 36. Dry end 14 of papermaking machine 10 can generally be found at, near, or after drying area 34.

Figure 2:
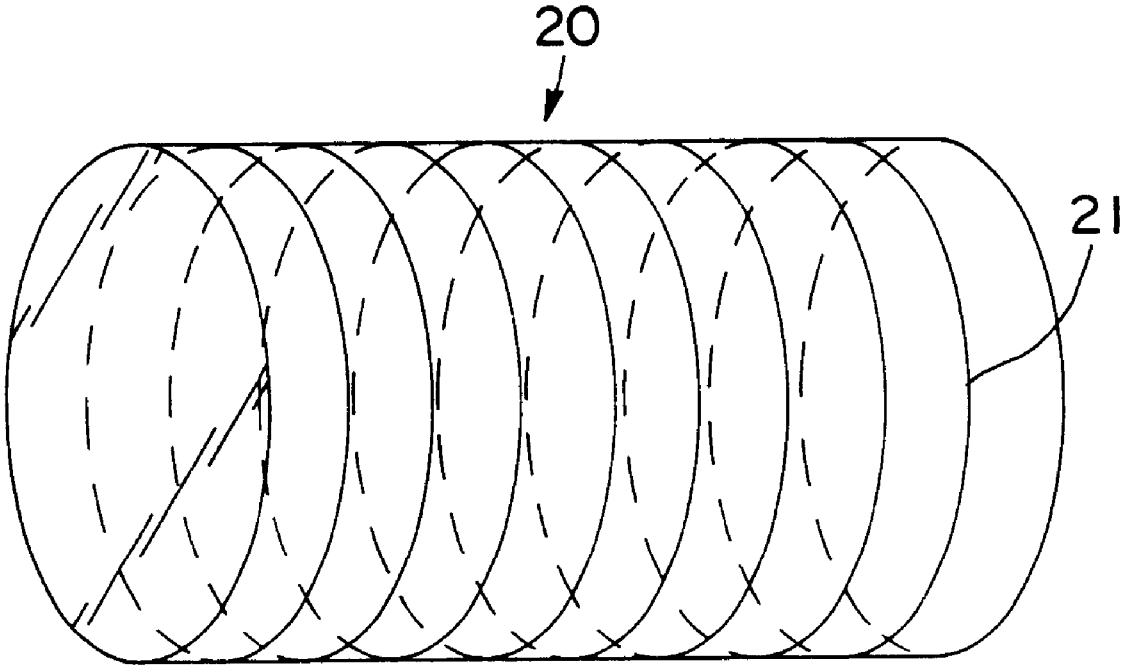
FIG. 2 shows a pictorial view of a roll for use in the papermaking machine of FIG. 1.

Dandy roll 20 is disposed at wet end 12 of papermaking machine 10, and generally has a rotational velocity which differs from the machine direction velocity of furnish 16. Referring to FIGS. 1 and 2, dandy roll 20 is used on furnish 16 as the primary deflocking device for the paper machine. Herein, "deflocking" is defined as the process of untangling and/or deconglomerating wood fibers/pulp in the furnish. The roll is also well known for use in making water marks. Water mark-type impressions are made in paper furnish 16 at wet end 12 of paper machine 10, also using dandy roll 20, wherein each respective water mark reflects a pattern of projections 21 axially protruding from the surface of dandy roll 20. While FIG. 2 illustrates projections 21 as circumferential projections on dandy roll 20, any projection, or series of projections, which results in effecting the desired watermark in the paper furnish is contemplated, such as longitudinal lines, company names, symbols, letters, numbers, and the like. Water marks are made by impressing the wet fibrous mat of furnish 16 with dandy roll 20, at wet end 12 of the paper machine. Whether in deflocking, or in making a water mark, areas of depression are formed on the paper "web" using dandy roll 20, while the web is still sufficiently wet, and the fibers sufficiently mobile, that the impressing projections of the roll move the fibers laterally, e.g. either in the machine direction or in a transverse machine direction, as opposed to simply compressing the fiber mat in a fixed location.

Whatever rearrangement of fibers of furnish 16 occurs before the critical dryness sets in, that rearrangement remains a characteristic of the finished product. "Critical dryness" is a characteristic of the furnish determined at the point in the paper making process when the solids content of web mass of fibers of furnish 16 is at a level, typically about 30% or more, at which rearrangement of the fibers is extremely difficult.

Such creation of water marks, and other rearrangements of the fibers, is known. It is also known that a water mark is often best viewed by holding the paper up to a light and letting the transmitted light shine through the paper. Thus, a "mark" so placed in the paper is thus visible by transmission of light, typically as an image, through the sheet at the "marked" area of the paper.

Figure 3:
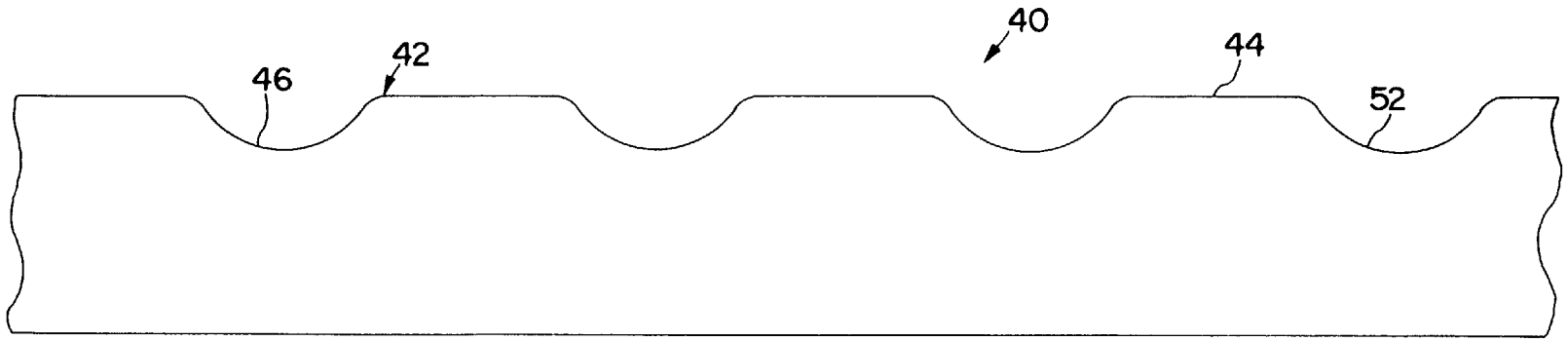
FIG. 3 shows a cross-sectional view of an embodiment of security paper of the invention.
Figure 4:
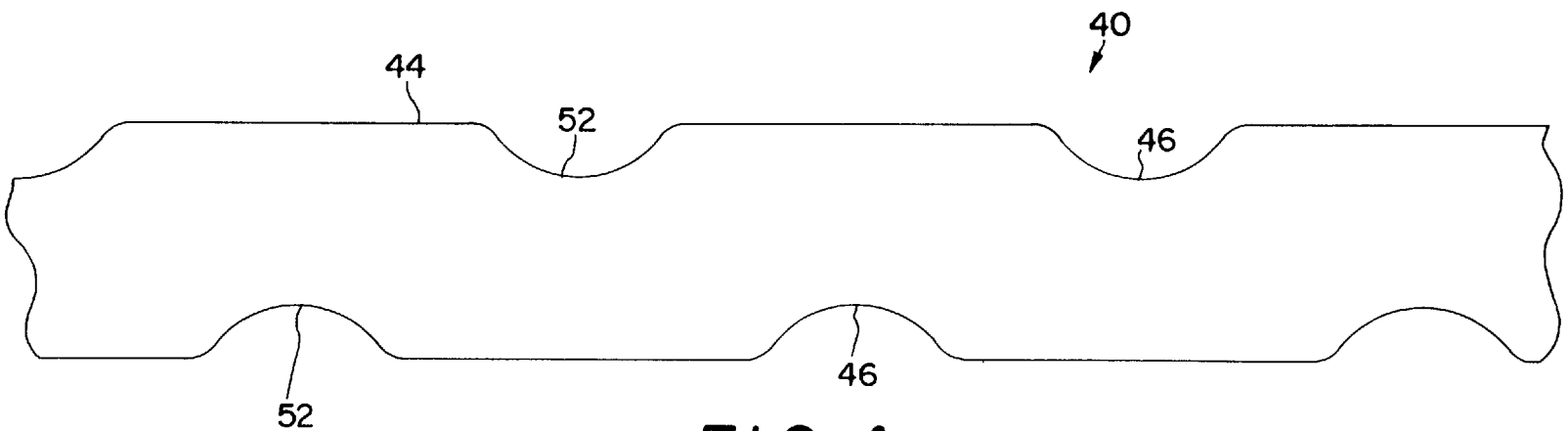
FIG. 4 shows a cross-sectional view of another embodiment of security paper of the invention.

Referring to FIG. 3, security paper 40 is illustrated having a base paper 42 comprising non-protection areas 44 and protection areas 46. Each of the protection areas preferably comprises a depression 52, thus rendering that portion of the protection area thinner than non-protection areas 44 of base paper 42. FIG. 4 shows another embodiment of the invention in that a second patterned roll can be used in the papermaking machine of FIG. 1 to create security paper 40 having protection areas 46 disposed on both major surfaces of the security paper. Such protection areas on the opposing surfaces can be laterally spaced from each other, as shown in FIG. 4, or can be opposite each other (not shown).

Herein, the term "major surface" in referring to e.g. security paper 40 or base paper 42, defines the area formed by the length and width of a respective sheet of paper, wherein the difference in thicknesses between protection areas and non-protection areas can be defined in a depth dimension of the respective paper substantially perpendicular to the major surfaces of the paper, such that each sheet of paper will only have two major surfaces.

It is known to provide an overall color on a water marked sheet. Thus, the fact that a sheet is water marked does not preclude making that sheet in color, or subsequently coloring the entire sheet in a process that uniformly distributes the colorant throughout the sheet.

In this invention, a novel image is created in the paper, at or near wet end 12 of paper machine 10, in the same manner as a conventional water mark, and can be contemplated as having the light transmission/translucence properties of a conventional water mark. Accordingly, the image so created is visible as a lighter image against a darker background when held up to a transmitted light.

Figure 5:
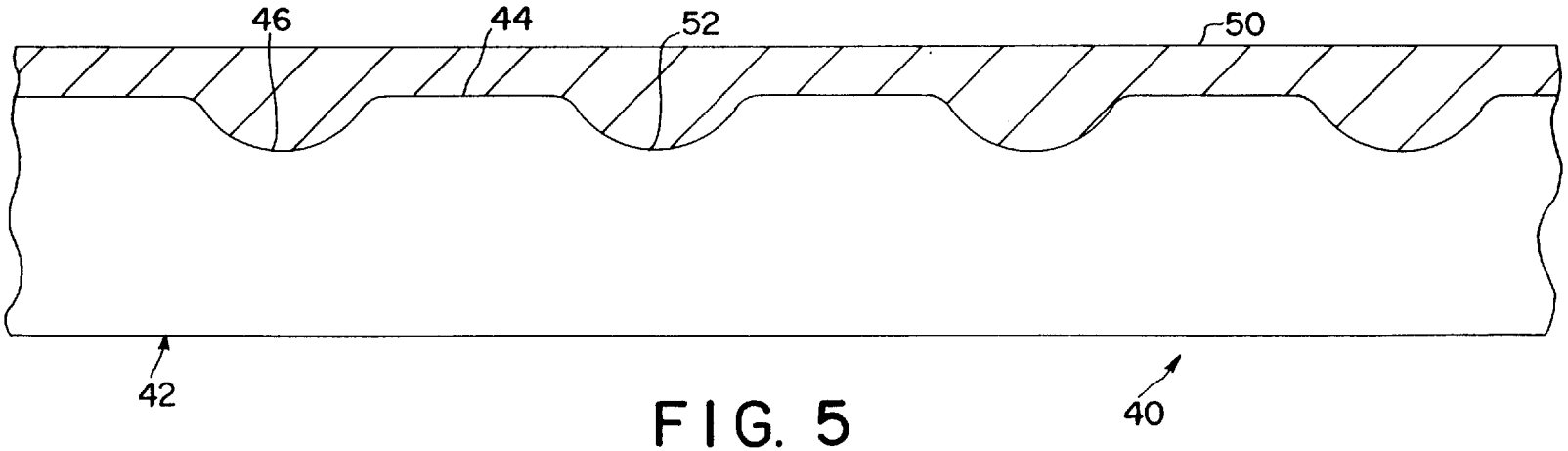
FIG. 5 shows a cross-sectional view of a security paper precursor of the invention being flooded with colorant such that the colorant pools in the depressions of the security paper.
Figure 6:
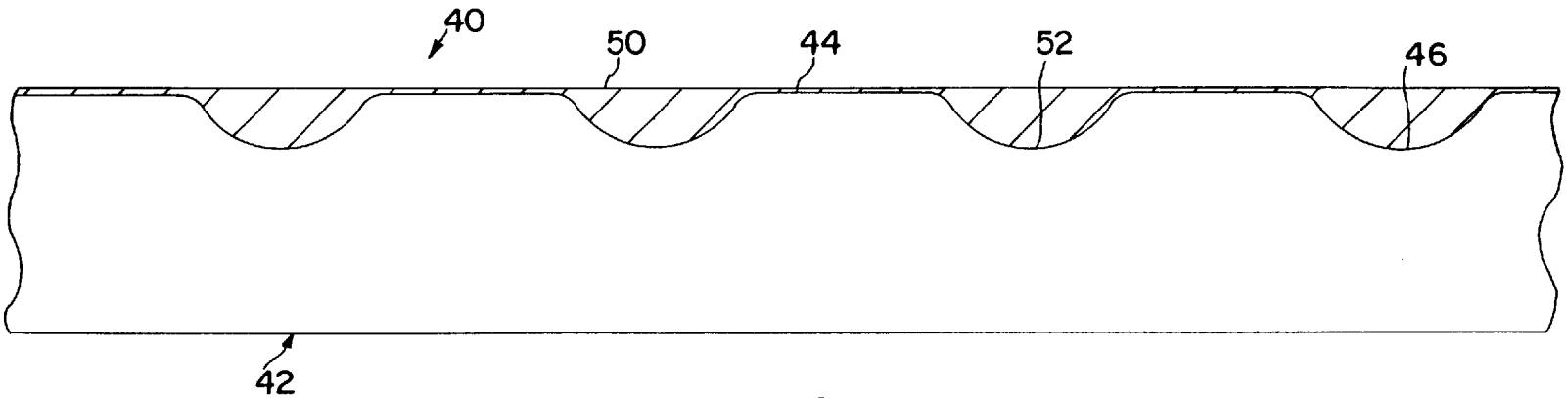
FIG. 6 shows a cross-sectional view of the security paper precursor of FIG. 5 demonstrating relative colorant remaining on the security paper after a portion of the colorant, as illustrated in FIG. 5, has been metered off.

Referring to FIGS. 5 and 6, as a novel departure from conventional water marking, in the invention, after the sheet fibers of furnish 16 have reached critical dryness and been positionally fixed, and sometime toward or beyond dry end 14 of paper machine 10 of FIG. 1, a defined quantity of colorant 50 is added to at least one side of the sheet. Because of depressions 52 in the sheet from the water marking, because of the sheet being essentially dry when colorant 50 is added, because of a limited quantity of colorant 50 being used, and because of the viscosity additives in the colorant, the applied colorant does not become uniformly dispersed throughout the sheet. Rather, the colorant remains on or close to the surface of the sheet, and tends to congregate in the depressions created by dandy roll 20 of FIG. 1 in the water marking process, thus to concentrate the colorant at the water marks.

In preferred embodiments, colorant 50 is a liquid mixture of the colorant and a substance to increase the viscosity of the mixture, e.g. ethylated starch. Increasing the viscosity level of the colorant enables the colorant to pool in depressions 52 rather than being automatically absorbed into the paper wherever the colorant is disposed. Such an increase in viscosity enables a manufacturer to uniformly apply colorant to the security paper precursor while still achieving the selective depressional congregation which results in the novel variation of color between the protection areas and non-protection areas, both in reflected and transmitted light.

Since the colorant is concentrated at the water mark locations, the now-modified "water mark" is visible as a darker color indication when viewed using reflected light (e.g. sitting on the desk) while remaining visible as a lighter color indication at the water mark location when viewed using transmitted light.

A preferred embodiment of both methods and security paper of the invention can be understood in the following example. In such a preferred embodiment, the colorant comprises Clariant Blue GNS paper dye, available from Clariant Corporation Coventry, R.I., added to a 10% ethylated starch solution at 0.3% colorant-volume/starch-solution-volume. The colorant is then applied to the security paper precursor via e.g. billblade coater which is generally stationed in-line on the paper machine, near or after the dryer area. The colorant is applied to the paper which includes the depressions when the paper demonstrates about 2% moisture, and approximately 0.35 Dry Lb. of colorant per ream of paper, each ream comprising 25"×38"×500 sheets. The colorant is then dried in a standard section of the papermaking machine, e.g. dryer cans, at a temperature of 170–230 degrees Fahrenheit. The security paper preferably travels through the drying process of the papermaking machine at a rate of approximately 800–1000 feet per minute.

The preferred method to control the preferential settling of colorant in the depressed areas is through the method of colorant-application implemented. In one such preferred method, an air knife coater and/or the above-mentioned billblade coater are used to control the amount of colorant on base paper 42. In any case, the colorant is pooled on base paper 42 in excess as shown in FIG. 5. The colorant is then metered off by the air of the air knife and/or by the blade of the billblade to produce an embodiment like the one shown in FIG. 6. Still referring to FIG. 6, the coating is generally metered in line with the surface of the sheet, thus enabling the pools of colorant disposed in the depressions to remain.

Clearly, there is a distinct window defining the quantity of colorant which can be applied to base paper 42. The specific quantity will depend on the characteristics of the colorant as well as the characteristics of the base paper, and the interaction(s) between the two. If too little colorant is applied, the water marks will not be distinguishable; if too much colorant is applied, the colorant may block transmission of light through the sheet at the water marks to the extent that the water marks are no longer visibly lighter than the non-water marked areas.

Those colorants which themselves are more translucent or transparent, such as dyes, can be applied over a greater range of application weights. Colorants which themselves are more opaque, such as pigments, will have lesser ranges of application weights. Additionally, some pigments of a solid form are contemplated for use in the invention in a variety of methods including dissolving such pigment in a solution including e.g. in combination with a surfactant. Some colorants will themselves be so opaque that no application weight will provide the combination of both a darker indication in reflected light and a lighter indication under transmitted light. So some colorants will not be useful at all.

In the embodiments of FIG. 4, similar results are likely using colorant on both sides of the sheet. However, such methods would have two applications of colorant which might increase time of production. Additionally, transmitted light would have to go through two layers of colorant in security paper manufactured using such methods, thus significantly limiting the intensity of color that could be placed on any one side of the sheet; therefore, the single side coating is preferred.

In some embodiments, it is contemplated that the colorant does not have to be applied to the base paper while on the paper machine. The colorant could well be applied later in a converting step. But, for fraudulent reproduction purposes, and as a practical matter, one would have to have access to the water-marked sheet. Since sale of such sheets is carefully controlled, an additional security feature is thus provided.

In summary, the paper must be sufficiently thin and/or the fibers sufficiently dispersed in the finished sheet, in the water mark area, that some light can get through.

Further, referring to FIGS. 3 and/or 4, the water marking step must create a true thickness variation, and preferably substantially no fiber density variation, between depression (s) 52 of protection area 46 of base paper 42 and the non-protection area in base paper 42, such that colorant 50 can be applied to achieve the desired "pooling" affect in depressions 52.

Also, the quantity and opacity of the colorant at the water mark must be sufficiently light so as to not block transmission of light at the water mark, and must result in transmission of light through the combination of the fibers and the colorant being greater than, or at least discernibly different from, the transmission of light through those portions of the sheet which are not water marked. At the same time, the quantity and opacity of the colorant at the water mark must be sufficiently intense that reflected light attenuation at the water mark is greater at the water mark than the non-water marked areas, so as to leave a darker reflected image at the water marked areas than at the non-water marked areas.

As a practical matter, all the above-mentioned invention features must coordinate with any ancillary colorant which is generic to base paper 42. Thus a base paper, while preferably a shade of white or light-colored, can be generally colored and still bear the modified water mark of the invention. But, for the invention to work, the base paper must have a generally light colored background against which the colorant of interest can be assessed in accord with the above conditions. Namely, this invention will not work with a black or nearly black base sheet.

Additionally, the water mark can only be applied at or near wet end 12 of the paper machine before critical dryness sets in, thus, truly ensuring lateral movement of the fibers in creating a water mark-type indication rather than compressing the fibers of the furnish.

Further, the colorant can only be added when the sheet is substantially dry, such as between dryers. Addition of the colorant after substantial drying avoids bleed, strike-through, and like issues with mobility of the colorant. Further, addition of the colorant between dryers provides for cost effective application and drying of the colorant.

Lastly, only colorants which are consistent with light transmission through the sheet after drying are acceptable. Thus, certain pigment applications are ruled out, unless very light applications as in diluted solutions, since pigments are typically opaque. Accordingly, colorants are preferably limited to dyes, some pigments, and chromogenic materials which develop color indications under controlled conditions, such as pH, moisture, impact, crushing, and the like.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A method of manufacturing security paper, the method including:

(a) forming a light-colored base paper having a non-protection area of a first thickness, and a protection area of a second thickness on at least one major surface of said base paper wherein said first thickness is greater than said second thickness; and (b) treating a major surface of said base paper with colorant such that the effective quantities and opacities of colorant at the respective protection area and the non-protection area result in transmission of light through the combination of fibers and colorant at the protection area and the non-protection area so as to produce a visually lighter color at the protection area than at the non-protection area; and such that the same quantity and opacity of colorant at the respective protection area and non-protection area is sufficiently intense that reflected light attenuation at the protection area is greater than reflected light attenuation at the non-protection area, so as to produce a visually darker color at the protection area than at the non-protection area, when viewed using reflected light.

2. A method as in claim 1 including applying colorant to only one major surface of the base paper.

3. A method as in claim 1 including applying the colorant on or close to a major surface of the base paper, whereby such colorant selectively congregates in depressions of the protection area, said depressions being defined by a difference in thickness between said non-protection area and said protection area, thus to concentrate the colorant at the protection area.

4. A method as in claim 1 including applying a sufficient quantity of the colorant at the protection area to develop sufficient opacity that reflected light attenuation at the protection area is greater than reflected light attenuation at the non-protection area, so as to appear to leave a darker reflected image at the protection area than at the non-protection area.

5. A method as in claim 1 including establishing the second thickness of the protection area while solids-content of a precursor web mass of fibers of said base paper is 10% by weight or less, thus enabling lateral movement of fibers, and therefore substantially uniformly distributing the fiber density at and adjacent the protection area.

6. A method as in claim 1 including applying the colorant to the base paper when such base paper is substantially dry.

* * * * *